US010023932B2

(12) United States Patent
Han et al.

(10) Patent No.: US 10,023,932 B2
(45) Date of Patent: Jul. 17, 2018

(54) GRAIN-ORIENTED ELECTRICAL STEEL SHEET, AND METHOD FOR MANUFACTURING THE SAME

(71) Applicant: POSCO, Pohang-si, Gyeongsangbuk-do (KR)

(72) Inventors: Min Soo Han, Pohang-si (KR); Min Serk Kwon, Pohang-si (KR); Soon-Bok Park, Pohang-si (KR); Chan-Hee Han, Pohang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 380 days.

(21) Appl. No.: 14/758,212

(22) PCT Filed: Dec. 26, 2013

(86) PCT No.: PCT/KR2013/012224
§ 371 (c)(1),
(2) Date: Jun. 26, 2015

(87) PCT Pub. No.: WO2014/104762
PCT Pub. Date: Jul. 3, 2014

(65) Prior Publication Data

US 2016/0194731 A1 Jul. 7, 2016

(30) Foreign Application Priority Data

Dec. 28, 2012 (KR) ..... 10-2012-0156915

(51) Int. Cl.

| | |
|---|---|
| ***H01F 1/04*** | (2006.01) |
| ***C21D 9/46*** | (2006.01) |
| ***C21D 8/12*** | (2006.01) |
| ***C21D 9/56*** | (2006.01) |
| ***C23C 8/02*** | (2006.01) |
| ***C23C 8/26*** | (2006.01) |
| ***C23C 8/80*** | (2006.01) |
| ***C21D 3/04*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/60*** | (2006.01) |
| ***C23F 11/02*** | (2006.01) |

(52) U.S. Cl.

CPC ..... *C21D 9/46* (2013.01); *C21D 3/04* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0257* (2013.01); *C21D 8/0263* (2013.01); *C21D 8/0273* (2013.01); *C21D 8/12* (2013.01); *C21D 8/1283* (2013.01); *C21D 9/56* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/60* (2013.01); *C23C 8/02* (2013.01); *C23C 8/26* (2013.01); *C23C 8/80* (2013.01); *C23F 11/02* (2013.01); *C21D 8/1255* (2013.01)

(58) Field of Classification Search

CPC . C21D 9/46; C21D 3/04; C21D 6/005; C21D 6/008; C21D 8/0205; C21D 8/0226; C21D 8/0236; C21D 8/0257; C21D 8/0263; C21D 8/0273; C21D 8/1283; C21D 9/56; C21D 8/12; C21D 8/1255; C22C 38/002; C22C 38/001; C22C 38/04; C22C 38/008; C22C 38/02; C22C 38/06; C22C 38/60; C23F 11/02; C23C 8/80; C23C 8/26; C23C 8/02

See application file for complete search history.

(56) References Cited

U.S. PATENT DOCUMENTS

| | | | | |
|---|---|---|---|---|
| 4,457,980 A * | 7/1984 | Daniels | ..... | D06M 11/46 427/282 |
| 4,507,350 A * | 3/1985 | Hendrix | ..... | D06P 1/44 427/282 |
| 4,543,134 A | 9/1985 | Tanaka et al. | | |

(Continued)

FOREIGN PATENT DOCUMENTS

| | | |
|---|---|---|
| CN | 101952462 A | 1/2011 |
| EP | 0577124 A2 | 1/1994 |

(Continued)

OTHER PUBLICATIONS

Machine translation of JP 06346247A (no date available).*
Machine translation of JP 11036018A (no date available).*
European Search Report dated Dec. 22, 2015 issued in European Patent Application No. 13867879.2.
Chinese Office Action dated Feb. 1, 2016 issued in Chinese Patent Application No. 201380068919.8.

(Continued)

*Primary Examiner* — Kiley Stoner
(74) *Attorney, Agent, or Firm* — McDermott Will & Emery LLP

(57) ABSTRACT

An oriented electrical steel sheet and a method of manufacturing the same are provided, and in a method of manufacturing an oriented electrical steel sheet including processes of producing a hot rolled plate by hot rolling a steel slab, performing or omitting hot rolled plate annealing, performing cold rolling, performing decarburization and nitride annealing, and performing final high temperature annealing, the decarburization and nitride annealing process is performed in a dew point range of 35-55° C., and in the final annealing process, a glassless additive including MgO is applied.

13 Claims, No Drawings

(56) References Cited

U.S. PATENT DOCUMENTS

| | | | | |
|---|---|---|---|---|
| 4,562,107 | A * | 12/1985 | Daniels | D06P 1/0096 427/282 |
| 4,875,947 | A | 10/1989 | Nakayama et al. | |
| 2008/0299059 | A1* | 12/2008 | Quadir | A61K 8/11 424/61 |
| 2008/0299154 | A1* | 12/2008 | Barrios | A61K 8/042 424/401 |
| 2014/0209290 | A1* | 7/2014 | Jamison | E21B 21/01 166/90.1 |
| 2014/0209307 | A1* | 7/2014 | Jamison | E21B 43/16 166/292 |
| 2014/0209386 | A1* | 7/2014 | Jamison | C09K 8/032 175/65 |
| 2014/0209387 | A1* | 7/2014 | Jamison | C09K 8/032 175/65 |
| 2014/0209388 | A1* | 7/2014 | Jamison | E21B 21/00 175/65 |
| 2014/0209390 | A1* | 7/2014 | Jamison | E21B 21/06 175/213 |
| 2014/0209391 | A1* | 7/2014 | Jamison | C09K 8/03 175/217 |
| 2014/0209392 | A1* | 7/2014 | Jamison | C04B 20/1033 175/217 |
| 2014/0209393 | A1* | 7/2014 | Jamison | E21B 21/00 175/217 |
| 2014/0213488 | A1* | 7/2014 | Jamison | C09K 8/032 507/105 |
| 2016/0303025 | A1* | 10/2016 | Kinjalbahen | A61Q 1/12 |

FOREIGN PATENT DOCUMENTS

| | | | |
|---|---|---|---|
| EP | 0589418 | A1 | 3/1994 |
| JP | S59-226115 | A | 12/1984 |
| JP | 61-236105 | A | 10/1986 |
| JP | 06-41642 | A | 2/1994 |
| JP | H06-100931 | A | 4/1994 |
| JP | 06-136555 | A | 5/1994 |
| JP | 06346247 | A * | 12/1994 |
| JP | 7-018333 | A | 1/1995 |
| JP | H07-54155 | A | 2/1995 |
| JP | 2688147 | B2 | 12/1997 |
| JP | H10130726 | A | 5/1998 |
| JP | 11-36018 | A | 2/1999 |
| JP | 11-071683 | A | 3/1999 |
| JP | H11-269555 | A | 10/1999 |
| JP | 2000-038615 | A | 2/2000 |
| JP | 3098691 | B2 | 10/2000 |
| JP | 2001-303258 | A | 10/2001 |
| JP | 2003-082472 | A | 3/2003 |
| JP | 2005-290445 | A | 10/2005 |
| JP | 2006-501371 | A | 1/2006 |
| JP | 2008-127635 | A | 6/2008 |
| JP | 2011-510166 | A | 3/2011 |
| JP | 2011-518947 | A | 6/2011 |
| KR | 10-1998-026185 | A | 7/1998 |
| KR | 10-1999-0078406 | A | 10/1999 |
| KR | 10-2001-0031919 | A | 4/2001 |
| KR | 10-2002-0074312 | A | 9/2002 |
| KR | 10-0377566 | B1 | 3/2003 |
| KR | 2003-0053746 | A | 7/2003 |

OTHER PUBLICATIONS

International Search Report and Written Opinion dated Mar. 25, 2014 issued in International Patent Application No. PCT/KR2013/012224 (English translation).

* cited by examiner

GRAIN-ORIENTED ELECTRICAL STEEL SHEET, AND METHOD FOR MANUFACTURING THE SAME

RELATED APPLICATIONS

This application is the U.S. National Phase under 35 U.S.C. § 371 of International Application No. PCT/KR2013/012224, filed on Dec. 26, 2013 which in turn claims the benefit of Korean Patent Application No. 10-2012-0156915 filed on Dec. 28, 2012, the disclosures of which the applications are incorporated by reference herein.

TECHNICAL FIELD

The present invention relates to an oriented electrical steel sheet and a method of manufacturing the same. More particularly, the present invention relates to an oriented electrical steel sheet and a method of manufacturing the same that remove a surface pinning effect that causes magnetism deterioration of a product by intentionally preventing an oxidation layer that is generated in a decarburization annealing process and a base coating layer that is generated through a chemical reaction of a MgO slurry that is used as a fusion-bonding inhibitor of a coil.

BACKGROUND ART

An oriented electrical steel sheet contains 3.1% of a Si component and has a texture in which an orientation of grains is a {110}<001> direction, and because the product has an excellent magnetic characteristic in a rolling direction, the product is used as an iron core material of a transformer, a motor, a generator, and other electrical devices using the characteristic.

Recently, while an oriented electrical steel sheet of a high magnetic flux density is commercially available, a material having small iron loss has been requested. In an electrical steel sheet, iron loss may be enhanced with four technical methods including a first method of accurately orienting a {110}<001> grain direction of a magnetic easy axis of an oriented electrical steel sheet in a rolling direction, a second method of forming a material in a thin thickness, a third method of minutely forming a magnetic domain through a chemical and physical method, and a fourth method of enhancing a surface property or imparting surface tension by a chemical method such as surface processing.

Excellent insulating coating in an oriented electrical steel sheet should generally have a uniform color that does not have a defect in an external appearance, but by adding several technologies that impart a function, technology that enhances an electrical insulating property and that reinforces a close contacting property of a film is generally used.

However, currently, while a request for a low iron loss oriented electrical steel sheet increases, it is requested that a final insulating film has high tension, and it has been determined that an actual high tension insulating film largely contributes to magnetic characteristic enhancement of a final product.

In order to improve a characteristic of a tension film, a control technique of several process factors has been applied, and an oriented electrical steel sheet presently available as a product obtains an iron loss reduction effect by adding a tension stress to a steel sheet by using a difference of a thermal expansion coefficient of an insulating film that is formed on a forsterite ($Mg_2SiO_4$, hereinafter, base coating)-based base film and a steel sheet.

As a representative insulating film forming method, in Japanese Unexamined Patent Application No. H11-71683, a method of improving film tension using colloidal silica having a glass transition point of a high temperature is disclosed, or in Japanese Patent No. 3098691 and Japanese Patent No. 2688147, a technology that forms an oxide film with high tension in an electrical steel sheet using alumina sol of an alumina subject and a boric acid mixture liquid is suggested.

Further, by actively enhancing a property of an oriented electrical steel sheet surface, magnetism of a material may be enhanced, and by removing an oxidation layer that is inevitably generated in a decarburization annealing process among a process and a base coating layer that is generated through a chemical reaction of a MgO slurry that is used as a fusion-bonding inhibitor of a coil, an object thereof can be achieved.

Technology that removes the base coating includes a method of forcibly removing a product in which base coating is already formed like a common material with sulfuric acid or hydrochloric acid, and this is disclosed in Japanese Patent No. 1985-076603.

However, in such a case, a complex process such as chemical polishing or electrolytic polishing is required, and particularly, in order to remove a surface with a constant thickness, there is a difficulty that an acid concentration in a process should be constantly maintained and a processing cost offsets a performance improvement effect of a product.

Further, when surface roughness of an obtained product is excessively smooth, insulating coating cannot be performed on the product, and thus a close contacting property may not be secured and an insulating property is very poor without using a physical/chemical deposition method.

In order to overcome such a technical limitation, in a process of generating a base coating, technology (hereinafter, glassless technology) that removes or suppresses the base coating was suggested (U.S. Pat. No. 4,543,134) and was performed in two directions of technology that adds a chloride to MgO, which is an annealing separating agent, and that uses a surface etching effect in a high temperature annealing process, and technology that does not form a base coating in a high temperature annealing process by applying Al2O3 powder as an annealing separating agent.

First, in glassless technology, technology that does not form a base coating using $Al_2O_3$ powder performs a process of (decarburization annealing)—(acid pickling)—($Al_2O_3$ application)—(high temperature annealing)—(forming of oxide film by preliminary annealing)—(tension film coating), and is a method using a property in which $Al_2O_3$ does not react with an oxide layer existing at a material surface.

However, in the technology, $Al_2O_3$ that is used as an annealing separating agent should be very small and uniform in a powder form, but when producing an industrial use powder in a slurry for application having a grain size of about 2-10 μm, it is difficult to maintain the powder in a distribution state.

As another glassless technology, a method of removing a base coating includes a chloride addition method and performs a process of (decarburization annealing)—(MgO+chloride powder application)—(high temperature annealing)—(acid pickling)—(tension film coating), and has almost the same process as a common production method.

As in U.S. Pat. No. 4,875,947, a representative chloride addition method is technology that uses a fusion-bonding inhibitor, i.e., an annealing separating agent, between coil plates as a main component upon annealing MgO at a high temperature, and that forms an $FeCl_2$ film by enabling a chloride to react with a material surface while high temperature annealing by adding the chloride (hereinafter, conventional glassless additive) such as one based on Ca, Li, K, Na, and Ba to the annealing separating agent and prevents a glass film layer from being formed by removing the $FeCl_2$ film by evaporation at a surface.

However, according to the technology, an oxide film having excellent application workability but still having a thin thickness exists, and obtained surface roughness is higher than that of a specimen that is produced by chemical polishing and thus only effects advantageous in workability, i.e., punching of a product due to a base coating member rather than an iron loss enhancement effect, may be expected.

Therefore, technology that can compensate this was suggested, and as described in Japanese Patent No. 1993-167164, a smoothed product having excellent roughness compared to that of an existing annealing separating agent using $BiCl_3$ as the chloride and having no residual material, compared with a general chloride, was obtained, and has excellent iron loss compared to that of a common product that forms a base coating.

However, in order to use MgO and $BiCl_3$ that are used in the technology as an annealing separating agent, when MgO and $BiCl_3$ are produced in a slurry phase together with water, as suggested by a spinel ($Al_2O_3$.MgO) by a reaction with active MgO and an Al component existing in steel, it is difficult to obtain a product having very low roughness and Fe oxide generation that is caused by dissociation of $BiCl_3$, which is together used chloride is accelerated and thus after high temperature annealing, a, Fe-based residual material remains at a material surface.

Due to the problem, it is very difficult to obtain an excellent product in terms of iron loss compared to that of an oriented electrical steel sheet general material and in which the base coating is excluded.

DISCLOSURE

Technical Problem

The present invention has been made in an effort to provide a base coating free type of electrical steel sheet and a method of manufacturing the same having advantages of very small iron loss by removing a pinning point, which is a main element that limits magnetic domain movement within a material by enabling a base coating layer that is limited to a smallest layer to be voluntarily removed during a high temperature annealing process.

Technical Solution

An exemplary embodiment of the present invention provides an annealing separating agent including MgO, an oxychloride material, and a sulfate-based antioxidant.

The oxychloride material may be antimony oxychloride (SbOCl) or bismuth oxychloride (BiOCl).

The sulfate-based antioxidant may be at least one that is selected from an antimony-based ($Sb_2(SO_4)3$), strontium-based ($SrSO_4$), or barium-based ($BaSO_4$) antioxidant.

The oxychloride material may be included at a ratio of 10-20 wt % to the MgO at 100-200 wt %, and the sulfate-based antioxidant may be included at a ratio of 1-5 wt % to the MgO at 100-200 wt %.

Another embodiment of the present invention provides a method of manufacturing an oriented electrical steel sheet including: producing a hot rolled steel sheet by hot rolling a steel slab; producing a cold rolled steel sheet by cold rolling the hot rolled steel sheet; performing decarburization annealing and nitride annealing on the cold rolled steel sheet; and applying an annealing separating agent including MgO, an oxychloride material, and a sulfate-based antioxidant, and a glassless additive including water, and performing final high temperature annealing on the electrical steel sheet of which the decarburization annealing and nitride annealing is complete.

The oxychloride material may be antimony oxychloride (SbOCl) or bismuth oxychloride (BiOCl).

The sulfate-based antioxidant may be at least one that is selected from an antimony-based ($Sb_2(SO_4)3$), strontium-based ($SrSO_4$), or barium-based ($BaSO_4$) antioxidant.

The oxychloride material may be included at a ratio of 10-20 wt % to the MgO at 100-200 wt %, and the sulfate-based antioxidant may be included at a ratio of 1-5 wt % to the MgO at 100-200 wt %.

An amount of $SiO_2$ that is formed at a surface of the electrical steel sheet of which the decarburization annealing and nitride annealing is complete may be two times to five times greater than that of $Fe_2SiO_4$.

The decarburization and nitride annealing process may be performed in a dew point range of 35-55° C.

An activation level of the MgO may be 400-3000 seconds.

Upon the final high temperature annealing, a temperature rising speed may be 18-75° C./h in a temperature range of 700-950° C., and a temperature rising speed may be 10-15° C./h in a temperature range of 950-1200° C.

Upon the decarburization and nitride annealing, a temperature may be 800-950° C.

The glassless additive may be applied at 5-8 g/$m^2$.

The steel slab may include Sn at 0.03-0.07 wt %, Sb at 0.01-0.05 wt %, and P at 0.01-0.05 wt %, the remaining portion may include Fe and other inevitably added impurities, and the steel slab may satisfy P+0.5Sb at 0.0370-0.0630 wt %.

Yet another embodiment of the present invention provides an oriented electrical steel sheet that produces a hot rolled steel sheet by hot rolling a steel slab including Sn at 0.03-0.07 wt %, Sb at 0.01-0.05 wt %, and P at 0.01-0.05 wt %, the remaining portion including Fe and other inevitably added impurities, and the steel slab satisfies P+0.5Sb at 0.0370-0.0630 wt %, and that produces a cold rolled steel sheet by cold rolling the hot rolled steel sheet and that performs decarburization annealing and nitride annealing on the cold rolled steel sheet, wherein an amount of SiO2 that is formed at a surface of the steel sheet of which the decarburization annealing and nitride annealing is complete is two times to five times greater than that of Fe2SiO4.

An oriented electrical steel sheet according to another embodiment of the present invention is an oriented electrical steel sheet in which final high temperature annealing is performed by applying an annealing separating agent including MgO, an oxychloride material, and a sulfate-based antioxidant, and an glassless additive including water, to the electrical steel sheet of which the decarburization annealing and nitride annealing is complete.

The oxychloride material may be antimony oxychloride (SbOCl) or bismuth oxychloride (BiOCl).

The sulfate-based antioxidant may be at least one that is selected from an antimony-based ($Sb_2(SO_4)3$), strontium-based ($SrSO_4$), or barium-based ($BaSO_4$) antioxidant.

The oxychloride material may be included at a ratio of 10-20 wt % to the MgO at 100-200 wt %, and the sulfate-based antioxidant may be included at a ratio of 1-5 wt % to the MgO at 100-200 wt %.

An amount of $SiO_2$ that is formed at a surface of the electrical steel sheet of which the decarburization annealing and nitride annealing is complete may be two times to five times greater than that of $Fe_2SiO_4$.

The decarburization and nitride annealing process may be performed in a dew point range of 35-55° C.

An activation level of the MgO may be 400-3000 seconds.

Upon the final high temperature annealing, a temperature rising speed may be 18-75° C./h in a temperature range of 700-950° C., and a temperature rising speed may be 10-15° C./h in a temperature range of 950-1200° C.

Upon the decarburization and nitride annealing, a temperature may be 800-950° C.

The glassless additive may be applied at 5-8 g/m$^2$.

Advantageous Effects

According to an exemplary embodiment of the present invention, an oxidation layer that is inevitably generated in a decarburization annealing process among a process of producing an oriented electrical steel sheet and a base coating layer that is generated through a chemical reaction of a MgO slurry that is used as a fusion-bonding inhibitor of a coil can be minimized.

Further, because a pinning point, which is a main element that limits magnetic domain movement by removing a base coating, may be excluded, iron loss of an oriented electrical steel sheet can be improved.

Further, by appropriately adjusting an activation level of MgO, which is a major component of an annealing separating agent and by introducing an oxychloride-based material, which is an insoluble compound and a sulfate-based antioxidant to an Fe-based oxide that is generated upon slurry application and drying by introducing MgO in which an activation level is limited, an oriented electrical steel sheet having excellent surface gloss and very excellent roughness can be produced.

MODE FOR INVENTION

These and other objects of the present application and a method of achieving them will become more readily apparent from the detailed description given hereinafter. However, it should be understood that the detailed description and specific examples while indicating preferred embodiments of the invention are given by way of illustration only since various changes and modifications within the spirit and scope of the invention will become apparent to those skilled in the art from this detailed description.

In an exemplary embodiment according to the present invention, as a means for achieving the object, entire control of a process of producing an oriented electrical steel sheet is required. In this case, a use material essentially includes Sn: 0.03-0.07 wt %, Sb: 0.01-0.05 wt %, and P: 0.01-0.05 wt %, and by hot rolling a steel slab essentially including Sn: 0.03-0.07 wt %, Sb: 0.01-0.05 wt %, and P: 0.01-0.05 wt %, a hot rolled plate of a 2.0-2.8 mm thickness is produced, and after annealing and acid pickling of the hot rolled plate, a cold rolled plate having a final thickness of 0.23 mm is produced via cold rolling.

In a process of performing a decarburization and nitriding treatment after cold rolling, by controlling the temperature, atmosphere, and dew point of a furnace, an amount of an oxidation layer that is generated at a material surface is adjusted so that $SiO_2$ becomes 2-5 times the $Fe_2SiO_4$. In this case, the dew point is adjusted to 35-55° C.

By mixing an annealing separating agent that is formed with MgO: 100-200 g, an oxychloride material: 10-20 g of an inorganic compound form having an insoluble property in an aqueous solution, and a sulfate-based antioxidant: 1-5 g with water: 800-1500 g in a material that is produced with the above method, by producing the mixture in a slurry, by drying, applying, and winding the slurry at 300-700° C., by maintaining a temperature rising rate of 15° C./h or more at a segment of 700-1200° C. in a 10% nitrogen-containing hydrogen atmosphere, by performing final high temperature annealing that soaks for 20 hours or more at a temperature of 1200±10° C., and by finally applying an insulating coating agent, an oriented electrical steel sheet is produced.

In an exemplary embodiment according to the present invention, an activation level of activated MgO that is used in the annealing separating agent is limited to 400-3000 seconds, and an oxychloride material of an inorganic compound form that is insoluble in an aqueous solution may be applied to an antimony-based or bismuth-based material.

Further, in an exemplary embodiment according to the present invention, as a sulfate-based material that is used as an anti-oxidizing agent, at least one of an antimony-based, strontium-based, and barium-based material may be used.

In an exemplary embodiment according to the present invention, when producing an oriented electrical steel sheet not having a base coating, a base coating free type of oriented electrical steel sheet in which a surface has very good roughness and gloss and in which iron loss is thus remarkably enhanced can be produced, compared with when producing a conventional glassless oriented electrical steel sheet, through a complex process not having economic efficiency such as acid pickling or chemical polishing or a process of evaporating at a surface after enabling an $FeCl_2$ film to form, as the chloride reacts with a material surface while high temperature annealing by adding a chloride to an annealing separating agent.

Hereinafter, a reason for limiting a component of an oriented electrical steel sheet according to an exemplary embodiment of the present invention will be described. This is because it is very appropriate in producing a base coating free type of electrical steel sheet that is suggested in an exemplary embodiment according to the present invention. Each element metallurgically contributes to improve magnetism of an oriented electrical steel sheet by the following operation.

In an exemplary embodiment according to the present invention, unless particularly described, a component content is measured in weight percent.

Sn: 0.03-0.07 wt %

When adding Sn, in order to reduce a size of a secondary grain, by increasing the number of secondary nuclei of a {110}<001> orientation, iron loss can be improved. Further, Sn performs an important function in suppressing grain growth through segregation in a grain boundary, and prevents AlN particles from coarsening and compensates weakening of an effect of suppressing grain growth by increasing a Si content. Therefore, even with a relatively high Si content, successful forming of the {110}<001> secondary recrystallization texture can be resultantly guaranteed. That is, a Si content can be increased and a final thickness can be reduced without weakening completeness of a {110}<001> secondary recrystallization structure. As described above, it is preferable that such a content of Sn is 0.03-0.07 wt % within a range in which a content of other components is appropriately adjusted. That is, as described above, when a content range of Sn is adjusted to 0.03-0.07 wt %, a discontinuous and remarkable iron loss reduction effect that could not be conventionally predicted may be determined, and thus a Sn content in an exemplary embodiment according to the present invention is limited to the range.

Further, when a Sn content excessively exists, there may be a problem that brittleness increases, and thus when adjusting Sn to the above-described range, it is effective in improving brittleness.

Sb: 0.01-0.05 wt %

Sb performs operation of suppressing excessive growth of a primary re-grain by segregating at a grain boundary. By removing non-uniformity of a primary recrystallized grain size according to a thickness direction of a sheet and simultaneously stably forming secondary recrystallization by suppressing grain growth at a primary recrystallization step by adding Sb, an oriented electrical steel sheet having excellent magnetism may be formed. Particularly, such an effect of Sb can be largely improved to a level that could not be predicted in a conventional document when containing Sb at 0.01-0.05 wt %.

Sb suppresses excessive growth of a primary recrystallized grain by segregating at a grain boundary, but when Sb at 0.01 wt % or less is contained, it is difficult to appropriately exhibit suppression thereof, and when Sb at 0.05 wt % or more is contained, a primary recrystallized grain size excessively decreases and thus a secondary recrystallization start temperature is lowered, whereby a magnetic characteristic is deteriorated or a suppressing force of grain growth excessively increases and thus secondary recrystallization may not occur Therefore, in an exemplary embodiment according to the present invention, a content of Sb is limited to the range.

P: 0.01-0.05 wt %

P promotes growth of a primary recrystallized grain in an oriented electrical steel sheet of a low temperature heating method and thus enhances integration of {110}<001> orientation in a final product by raising a secondary recrystallization temperature. When a primary recrystallized grain is excessively large, secondary recrystallization becomes unstable, but as long as secondary recrystallization occurs, it is advantageous in magnetism that a primary recrystallized grain is large to raise the secondary recrystallization temperature. P lowers iron loss of a final product by increasing the number of grains having the {110}<001> orientation in a primarily recrystallized steel sheet and improves {110}<001> integration of a final product by strongly developing a {111}<112> texture in a primary recrystallization plate and thus a magnetic flux density increases. Further, P reinforces a suppressing force by delaying decomposition of deposition by segregating at a grain boundary to a high temperature of about 1000° C. upon secondary recrystallization annealing. When such a content of P is limited to 0.01-0.05 wt %, a remarkable effect that could not be predicted in a conventional art can be obtained. In order to appropriately exhibit an effect of P, it is necessary to limit a content of P to 0.01 wt % or more, and when a content of P is 0.05 wt % or more, a size of a primary recrystallized grain is reduced and thus secondary recrystallization becomes unstable and brittleness is increased and thus cold rolling is impeded. Therefore, in an exemplary embodiment according to the present invention, a content of P is limited to the range.

P+0.5Sb: 0.0370-0.0630%

Further, in an exemplary embodiment according to the present invention, in addition to a case of adding the several elements, by adjusting a content of the P+0.5Sb to the above-described range, iron loss was further improved. This is because, by adding the elements together, a synergistic effect can be obtained, and when a synergistic effect satisfies the equation range, the synergistic effect is discontinuously maximized, compared with other numeral ranges. Therefore, in an exemplary embodiment according to the present invention, in addition to each component content, the P+0.5Sb is limited to the range.

In addition to the above metallurgical merit, Sn and Sb that are used as major elements are added to steel, and in an Fe—Si alloy like an oriented electrical steel sheet, high temperature oxidation resistance is improved.

This is a very important precondition for producing a base coating free product that is suggested in an exemplary embodiment according to the present invention, and for base coating free production, only an appropriate amount of a base coating layer should be generated through a selective reaction between a $SiO_2$ oxidation layer inevitably occurring during a decarburization annealing process and a MgO slurry that is used as an annealing separating agent, and it is very important to suppress an Fe-based oxidation layer that may produce other by-products.

Therefore, in an exemplary embodiment according to the present invention, in order to control quality of an oxidation layer that performs a most important function in a base coating free process as well as a meaning as a metallurgical element for improving magnetism of an oriented electrical steel sheet, a slab including Sn and Sb in steel is used as a start material.

Hereinafter, a method of producing an oriented electrical steel sheet according to an exemplary embodiment of the present invention will be described.

A hot rolled plate of 2.0-2.8 mm is produced by hot rolling the above-described steel slab, and after annealing and acid pickling of the hot rolled plate, cold rolling of the hot rolled plate is performed to a thickness of 0.23 mm, which is a final thickness. Thereafter, the cold rolled steel sheet undergoes decarburization annealing and recrystallization annealing, and this will be described in detail.

In order to generate an inhibitor that appropriately controls secondary recrystallization growth upon high temperature annealing while removing carbon that is included in steel, the cold rolled steel sheet undergoes decarburization and nitride annealing in a mixed gas atmosphere of ammonia+hydrogen+nitrogen. By setting a temperature within a furnace to about 800-950° C. under a humid atmosphere and at a temperature lower than 800° C., a sufficient decarburization annealing effect does not occur. As grains are maintained in a micro-state, upon secondary recrystallization, crystals of an undesirable orientation may grow, and when a temperature within a furnace is higher than 950° C., primary recrystallized grains may excessively grow. Upon decarburization and nitride annealing in an exemplary embodiment according to the present invention, a temperature within a furnace is limited to 800-950° C.

Further, it is advantageous for management of an oxidation layer to set about 50-70° C. to have a lower temperature by about 2-4° C. than that of a component system that does not contain Sn, Sb, and P, and it is more advantageous for grain orientation control or iron loss improvement of a final product.

As described above, from a metallurgical viewpoint, in a decarburization and nitride annealing process, an oxidation layer may be inevitably generated at a surface in a conventional oriented electrical steel sheet production process, and by applying a generated oxidation layer and a MgO slurry (aqueous solution in which MgO is dispersed in water), in a high temperature annealing process, a base coating ($Mg_2SiO_4$) layer is formed. A forsterite layer, i.e., a base coating that is generated in this way, generally prevents fusion-bonding between a plates of an oriented electrical steel sheet coil and gives tension to the plate, and thus it is known that iron loss is reduced and an insulating property is imparted to a material.

However, currently, while demand for a low iron loss and high magnetic flux density material increases, a thin thickness trend of a product is accelerated and thus a magnetic property that is damaged at the material surface side gradually becomes an important factor. From this viewpoint, a base coating that is generated through a reaction with an oxidation layer that is generated in a decarburization and nitride process and a MgO slurry that is used as an annealing separating agent operate to generate a pinning point that disturbs flow of magnetic domains moving through a material surface, and research for removing this has been performed.

When a cold rolled plate passes through a heating furnace that is controlled in a humid atmosphere for decarburization nitriding, Si having highest oxygen affinity in steel reacts with oxygen that is supplied from a water vapor within the furnace and thus $SiO_2$ is first formed at a surface, and as oxygen penetrates to the steel, an Fe-based oxide is generated. $SiO_2$ that is generated in this way forms the base coating through the following chemical reaction equation.

$$2Mg(OH)_2+SiO_2 \rightarrow Mg_2SiO_4+2H_2O \quad (1)$$

As in the reaction equation 1, when $SiO_2$ reacts with the MgO slurry in a solid state, in order to perform a complete chemical reaction, a material with a catalyst function of connecting between two solids is required, and fayalite ($Fe_2SiO_4$) performs the catalyst function. Therefore, conventionally, appropriate fayalite forming as well as a $SiO_2$ forming amount was important.

However, in an exemplary embodiment according to the present invention, after minimally forming a base coating layer that disturbs magnetic domain movement of a material in a front end portion of a high temperature annealing process, the base coating layer is removed in a rear end portion, and thus it is unnecessary to form a large amount of $SiO_2$ and fayalite on a material surface to enable the $SiO_2$ and fayalite to react with MgO like a conventional production method. In such a case, in a decarburization and nitriding annealing process, it is advantageous to form a thin $SiO_2$ layer at a material surface through the control of a dew point, a soaking temperature, and an atmosphere gas, and to generate a very small amount of fayalite. This is because, in a conventional case, in order to perfectly induce a reaction between $SiO_2$ and MgO, fayalite, which is a relatively large amount of a catalyst material, is required, and in order to generate fayalite, Fe-based oxides such as FeO and $Fe_2SiO_3$ are essentially generated together. The generated FeO and $Fe_2SiO_3$ do not basically react with a glassless-based addition material and are attached to a material surface to form an FeO system of an oxide mound (hereinafter, Fe mound), and in such a case, a product having an enhanced surface in which base coating is excluded and excellent gloss cannot be obtained.

Therefore, in an exemplary embodiment according to the present invention, upon decarburization and nitride annealing, by imparting a change to a dew point temperature within a furnace, a change of an oxidation layer composition was induced, and an amount of fayalite and $SiO_2$ that is induced in this way was quantified through FT-IR.

As a result, in an amount of an oxidation layer that is formed at a surface, when $SiO_2$ is adjusted to two times to five times that of fayalite, roughness and glossiness of a surface were excellent, and when $SiO_2$ is adjusted to two times or less that of fayalite, an Fe mound defect occurs and thus surface roughness is deteriorated, while when $SiO_2$ is adjusted to five times or more that of fayalite, forsterite forming is very weak and thus fostelite forming is very poor, whereby at a material surface, much residual material exists.

Therefore, in an exemplary embodiment according to the present invention, $SiO_2$ is formed at two times to five times that of fayalite.

As described above, on a specimen in which an oxidation layer of a material is adjusted, a conventional glassless additive like $BiCl_3$ was mixed with MgO and water, applied, and finally annealed in a coil shape. Upon final annealing, a primary soaking temperature was 700° C., a secondary soaking temperature was 1200° C., and a temperature rising condition of a temperature rising segment was 18-75° C./h at a temperature segment of 700-950° C. and was 10-15° C./h at a temperature segment of 950-1200° C. A soaking time at 1200° C. was processed as 15 hours. An atmosphere upon final annealing was a mixed atmosphere of 25% nitrogen+75% hydrogen up to 1200° C., and after arriving at 1200° C., a 100% hydrogen atmosphere was maintained and the furnace was cooled.

In a specimen that is processed in this way, roughness and glossiness enhancement was excellent compared to that of a conventional glassless process, but an enhanced surface property of an acid pickling and chemical polishing level may not be obtained and a limitation exists in magnetism enhancement.

Therefore, in an exemplary embodiment according to the present invention, when components that are used for an annealing separating agent are applied and dried at a surface of a material, a material remaining at a surface after high temperature annealing and reaction mechanism on each component basis was researched.

First, after high temperature annealing, when analyzing a residual material of a specimen in which a base coating is not completely removed, the residual material was determined as a spinel-based ($MgO.Al_2O_3$) compound and an Fe-based oxide. Further, when such a residual material remains, a magnetic characteristic that a low iron loss oriented electrical steel sheet requires may not be satisfied. Therefore, in an exemplary embodiment according to the present invention, in order to ultimately overcome a limitation of a conventional glassless type and to remarkably enhance iron loss of an oriented electrical steel sheet, research has been performed with an emphasis on the above characteristic deterioration material forming mechanism.

When an activation level of MgO which a main component of an annealing coating agent is high, a spinel-based oxide, which is a primary characteristic deterioration cause of characteristic deterioration causes that are suggested in the foregoing description, reacts with $SiO_2$ existing at a surface like reaction equation 1 to form a base coating layer and reacts with a surface oxidation layer and Al, which is a component among steel existing at a material interface, and thus it is determined that the above spinel-based composite oxide has occurred. In order to prove this, in an exemplary embodiment according to the present invention, by artificially adjusting an activation level of MgO, MgO having various activation levels was produced. An activation level of the MgO is defined as an ability in which MgO powder may cause a chemical reaction with other components, and is measured as a time that is taken for MgO to completely neutralize a predetermined amount of citric acid solution.

In MgO that is generally used as an annealing separating agent for a common oriented electrical steel sheet, high activation is used, with an activation level of about 50-300 seconds, and in an exemplary embodiment according to the present invention, in addition to MgO having a common activation level, by applying an activation level of MgO to adjusted MgO through a high temperature firing process, a spinel-based compound was suppressed from remaining as a residual material.

Particularly, in an exemplary embodiment according to the present invention, an activation level of MgO is limited to 400-3000 seconds, and when an activation level is smaller than 400 seconds, after high temperature annealing, spinel-based oxide remains at a surface like common MgO, while when an activation level is larger than 3000 seconds, an activation level is excessively weak and thus MgO does not react with an oxidation layer existing at a surface and a base coating layer may thus not be formed. Therefore, in an exemplary embodiment according to the present invention, an activation level of MgO is limited to 400-3000 seconds.

A second cause of magnetic characteristic deterioration is Fe-based oxide. As described above, generation of the Fe-based oxide is limited through introduction of Sn and Sb in steel as well as the control of a dew point and an atmosphere within a furnace in a decarburization and nitriding process. However, in spite of such a limitation, a generation cause of the Fe-based oxide is related to a chemical reaction between chloride that is used as a glassless additive and an aqueous solution that is used for distributing an annealing separating agent. When $BiCl_3$ that is well known as a chloride of a conventional glassless system is generally applied on a specimen as an aqueous solution together with MgO and a high temperature annealing process is performed, the following chemical reaction occurs at a surface.

$$BiCl_3+H_2O \rightarrow BiOCl(s)+2HCl \quad (2)$$

As in the chemical reaction equation 2, 2HCl that is generated on an aqueous solution causes the following chemical reaction together with Fe or FeO existing at a material surface.

$$(Fe,FeO)+HCl \rightarrow FeCl_2(s)+H_2O \quad (3)$$

Therefore, in order to apply an annealing separating agent in which a common glassless additive is introduced and to form the annealing separating agent in a coil shape, when drying the annealing separating agent at 700° C. or less, an Fe-based oxidation layer is already generated, and a material that is generated in this way forms a deep root at a material surface during a high temperature annealing process.

In order to suppress such a phenomenon, by using $BiCl_3$ having strong oxidation or an antimony oxychloride (SbOCl) additive that is not dissociated within an aqueous solution other than chloride of a line similar to $BiCl_3$ and that originally suppresses Fe-based oxide and antimony sulfate ($Sb_2(SO_4)3$)) not having a Cl group, an exemplary embodiment according to the present invention is to solve such problem.

That is, in order to produce an oriented electrical steel sheet having excellent gloss, roughness, and iron loss, MgO: 100-200 g in which activation is adjusted by an annealing separating agent, antimony oxychloride (SbOCl): 10-20 g having an insoluble property in an aqueous solution, antimony sulfate ($Sb_2(SO_4)3$)): 1-5 g, and water 800-1500 g are mixed, are formed in a slurry form, are applied in a thickness of 5-8 g/m2 at a surface of a material in which decarburization and nitriding is terminated, and are dried at 300-700° C. After a specimen that is produced in this way is produced in a coil shape, the specimen undergoes high temperature annealing, and a temperature rising speed of a fast temperature rising speed segment of an initial process of high temperature annealing is determined to be 18-75° C./h, while a slow temperature rising speed is determined to be 10-15° C./h in consideration of secondary recrystallization. In this case, thermal decomposition of a glassless-based additive within an annealing separating agent at a first half of a high temperature annealing process is performed at about 280° C. as follows.

$$2SbOCl \rightarrow Sb2(s)+O_2(g)+Cl_2(g) \quad (4)$$

As in the chemical reaction equation 4, unlike $BiCl_3$ or $SbCl_3$ in which a Cl group may be dissociated in an aqueous solution, in a chloride of an oxychloride form, a Cl group is generated only through thermal decomposition, and after antimony oxychloride is produced in a slurry state on an aqueous solution, in an application and drying process, an Fe-based oxide that may ultimately impede roughness, glossiness, and iron loss reduction is not generated.

A Cl gas that is separated in this way forms $FeCl_2$ at an interface of a material and an oxidation layer while being again diffused toward a material surface rather than being discharged to the outside of a coil by a pressure within a furnace operating in the coil.

$$Fe(material)+Cl_2 \rightarrow FeCl_2(\text{interface of material and oxidation layer}) \quad (5)$$

Thereafter, at about 900° C., by a MgO and $SiO_2$ reaction, at an outermost surface of a material, base coating is performed as in Equation 5. Thereafter, at about 1025-1100° C., $FeCl_2$ that has been formed at an interface of a material and an oxidation layer starts to be decomposed, and while $Cl_2$ gas that is decomposed in this way is discharged to an outermost surface of the material, the $Cl_2$ gas separates the base coating that has been formed in an upper portion from the material.

In an exemplary embodiment according to the present invention, after a slurry is produced, when the slurry is dried, an amount of chloride of an oxychloride form that does not impede iron loss reduction and that does not generate the Fe-based oxide is limited and is used at 10-20 g to an injected MgO amount of 100-200 g. When an amount of the chloride is injected to be smaller than 10 g, Cl to form enough $FeCl_2$ may not be supplied, and thus there is a limitation in improving roughness and glossiness after high temperature annealing, and when an amount of the chloride is injected to be larger than 20 g, an excessively greater amount than that of MgO, which is a major component of an annealing separating agent, disturbs the base coating from being formed and may thus metallurgically have an influence on secondary recrystallization as well as a surface, and thus in an exemplary embodiment according to the present invention, for MgO of 100-200 g, the chloride is limited to 10-20 g.

Antimony sulfate ($Sb_2(SO_4)3$) together with antimony oxychloride (SbOCl) is injected to thinly form a forsterite layer that is generated by a MgO and $SiO_2$ reaction, and is limited to 1-5 g for 100-200 g of MgO. When antimony sulfate ($Sb_2(SO_4)3$)) together with antimony oxychloride (SbOCl) of an amount smaller than 1 g is added, an effect as an additional auxiliary agent is slight, and antimony sulfate ($Sb_2(SO_4)3$)) together with antimony oxychloride (SbOCl) does not contribute to improvement of roughness and gloss, and when with antimony sulfate ($Sb_2(SO_4)3$)) together with antimony oxychloride (SbOCl) of an amount of more than 5 g is added, base coating forming may be disturbed due to a much greater amount than that of MgO, which is a major component of an annealing separating agent like antimony oxychloride (SbOCl), and thus in an exemplary embodiment according to the present invention, an addition amount of SbOCl and $Sb_2$ $(SO_4)3$ is limited to the range.

Hereinafter, an exemplary embodiment according to the present invention will be described in detail.

Exemplary Embodiment 1

In a component system that is suggested in the present invention and a common oriented electrical steel sheet component system, after Si: 3.26%, C: 0.055%, Mn: 0.12%, Sol. Al: 0.026%, N: 0.0042%, and S: 0.0045%, and Sn, Sb, and P contents were applied to a MgO annealing separating agent including common chlorides, roughness and glossiness were measured, and it was determined whether the base coating was formed. Here, the glossiness is Gloss glossiness, and in a reflection angle of 60°, an amount of light that is reflected from a surface is measured, where mirror surface glossiness of 1000 is base glossiness.

TABLE 1

| Specimen number | Sn content (wt %) | P content (wt %) | Sb content (wt %) | Glassless additive | Roughness (Ra: μm) | Glossiness (index) |
|---|---|---|---|---|---|---|
| 1 | 0 | 0 | 0 | $MgCl_2$ | 0.65 | 54 |
| | | | | $CaCl_2$ | 0.58 | 67 |
| 2 | 0 | 0 | 0.015 | $MgCl_2$ | 0.55 | 72 |
| | | | | $CaCl_2$ | 0.67 | 48 |
| 3 | 0 | 0.02 | 0 | $MgCl_2$ | 0.74 | 66 |
| | | | | $CaCl_2$ | 0.62 | 59 |
| 4 | 0 | 0.035 | 0.015 | $MgCl_2$ | 0.59 | 62 |
| | | | | $CaCl_2$ | 0.60 | 57 |
| 5 | 0.01 | 0.035 | 0.025 | $MgCl_2$ | 0.57 | 82 |
| | | | | $CaCl_2$ | 0.61 | 48 |
| 6 | 0.03 | 0.035 | 0.025 | $MgCl_2$ | 0.48 | 103 |
| | | | | $CaCl_2$ | 0.45 | 107 |
| 7 | 0.04 | 0.035 | 0.025 | $MgCl_2$ | 0.49 | 95 |
| | | | | $CaCl_2$ | 0.50 | 89 |
| 8 | 0.05 | 0.02 | 0.035 | $MgCl_2$ | 0.46 | 106 |
| | | | | $CaCl_2$ | 0.47 | 109 |
| 9 | 0.05 | 0.035 | 0.045 | $MgCl_2$ | 0.54 | 97 |
| | | | | $CaCl_2$ | 0.51 | 98 |
| 10 | 0.06 | 0.35 | 0.025 | $MgCl_2$ | 0.43 | 115 |
| | | | | $CaCl_2$ | 0.42 | 121 |

As shown in Table 1, after mixing a material that is known as a conventional glassless chloride annealing separating agent with MgO in Sn and Sb addition materials that are suggested in the present invention, by applying a slurry thereof, much better glossiness and roughness than a common oriented electrical steel sheet was obtained regardless of a kind of a chloride annealing separating agent. It may be indirectly seen that Sn and Sb in steel are related to improvement of high temperature oxidation resistance, and particularly have an effect that disturbs Fe oxide existing as a residual material from being formed upon performing a removal reaction of a forsterite layer of a chloride, i.e., a base coating in a high temperature annealing process by suppressing external oxidation. In an exemplary embodiment according to the present invention, Sn and Sb addition materials that are advantageous in suppressing external oxidation and removing a base coating were used as a testing material.

In Table 2, after cold rolling is performed to a thickness of 0.23 mm using an Sn and Sb addition steel slab (specimen number 10 component system) that is suggested in Table 1, when performing decarburization and nitride annealing, a change of an oxidation layer composition according to a dew point temperature within a furnace was induced, and base coating removal ability was compared through a difference of roughness and glossiness according to the induced change. In this case, a soaking temperature of a furnace is 875° C., and by simultaneously injecting a mixed atmosphere of hydrogen at 75%, nitrogen at 25%, and dry ammonia gas at 1%, and maintaining the state for 180 seconds, a simultaneous decarburization and nitride processing was performed.

In a decarburization and nitride annealing process, a composition of an oxidation layer and a total oxygen amount that is formed at a material surface is largely affected by a change of a dew point temperature within a furnace. As shown in Table 2, in an amount of an oxidation layer that is formed at a surface, when $SiO_2$ is adjusted to two times to five times that of $Fe_2SiO_4$, roughness and glossiness of the surface is excellent, and when $SiO_2$ is adjusted to two times or less that of $Fe_2SiO_4$, a Fe mound defect occurs and thus surface roughness is deteriorated, while when $SiO_2$ is adjusted to five times or more that of $Fe_2SiO_4$, $Fe_2SiO_4$ is very weakly formed and thus base coating forming is very poor, whereby at a material surface, much residual material exists. This is because excessively generated FeO and $Fe_2SiO_3$ do not basically react with a glassless-based additive and are attached to a material surface to form the Fe mound defect. In such a case, it can be seen that a product of an enhanced surface and excellent gloss in which base coating is excluded cannot be obtained.

TABLE 2

| Specimen number | Dew point temperature | Total oxygen amount (ppm) | $SiO_2$/FeO | Glassless additive | Roughness (Ra: μm) | Glossiness (index) |
|---|---|---|---|---|---|---|
| 1 | 35 | 340 | 7.2 | $MgCl_2$ | 0.32 | 114 |
| 2 | | | | $CaCl_2$ | 0.34 | 120 |
| 3 | | | | $BiCl_3$ | 0.31 | 126 |
| 4 | | | | $SbCl_3$ | 0.31 | 132 |
| 5 | 45 | 480 | 4.8 | $MgCl_2$ | 0.32 | 177 |
| 6 | | | | $CaCl_2$ | 0.34 | 172 |
| 7 | | | | $BiCl_3$ | 0.31 | 191 |
| 8 | | | | $SbCl_3$ | 0.31 | 194 |
| 9 | 55 | 630 | 2.3 | $MgCl_2$ | 0.39 | 160 |
| 10 | | | | $CaCl_2$ | 0.38 | 158 |
| 11 | | | | $BiCl_3$ | 0.35 | 179 |
| 12 | | | | $SbCl_3$ | 0.34 | 166 |

Therefore, in order to produce a base coating free type of oriented electrical steel sheet having excellent roughness and glossiness and having very good iron loss due to the excellent roughness and glossiness that is sought in an exemplary embodiment according to the present invention, a condition of an amount and a composition of an oxidation layer and a slab component system was derived from Tables 1 and 2. That is, in a cold rolled plate that is produced with a component system of specimen number 5 of Table 1, a specimen that is produced with an oxidation layer condition ($SiO_2/Fe_2SiO_4$=4.8) that is derived in Table 2 was used as a testing material, a new annealing separating agent for new base coating free that is suggested in an exemplary embodiment according to the present invention was produced and applied, as in Table 3, and a material characteristic including a magnetic property was compared.

When producing an annealing separating agent, the annealing separating agent was produced based on MgO at 100 g and water at 1000 g. As shown in Table 3, when using MgO having a high activation level and BiCl3 having strong oxidation, and MgO in which an activation level is appropriately adjusted instead of a chloride of a line similar thereto, in a specimen that applies an antimony oxychloride (SbOCl) additive that is not dissociated within an aqueous solution and that thus originally suppresses Fe oxide and antimony sulfate ($Sb_2(SO_4)3$) not having Cl group, an oriented electrical steel sheet having excellent roughness and gloss and very low iron loss was obtained.

TABLE 3

| MgO Activity level | Common glassless | Base coating free annealing separating agent | | Roughness | Glossiness | Magnetic flux Density | Iron loss | |
|---|---|---|---|---|---|---|---|---|
| (S) | ($BiCl_3$) | SbOCl | $Sb_2$ $(SO_4)3$ | (Ra: μm) | (index) | B10 | (W17/50) | Remark |
| 50 | — | — | — | — | — | 1.91 | 0.87 | Common material |
| | 5 | — | — | 0.31 | 191 | 1.91 | 0.90 | Comparative material |
| | 10 | — | — | 0.30 | 200 | 1.92 | 0.88 | |
| | — | 5 | — | 0.29 | 215 | 1.92 | 0.88 | |
| | — | 10 | — | 0.30 | 209 | 1.92 | 0.89 | |
| | — | 20 | — | 0.28 | 220 | 1.92 | 0.87 | |
| | — | 5 | 2.5 | 0.27 | 235 | 1.92 | 0.86 | |
| | — | 10 | 2.5 | 0.26 | 280 | 1.92 | 0.85 | |
| | — | 20 | 2.5 | 0.28 | 255 | 1.92 | 0.86 | |
| 500 | — | 5 | — | 0.26 | 288 | 1.92 | 0.85 | Comparative material |
| | — | 10 | — | 0.25 | 301 | 1.92 | 0.83 | |
| | — | 10 | 0.5 | 0.25 | 299 | 1.93 | 0.83 | |
| | — | 10 | 3.5 | 0.24 | 316 | 1.93 | 0.81 | Present invention |
| | — | 20 | 7.5 | 0.23 | 330 | 1.93 | 0.79 | Present invention |
| | — | 20 | 2.5 | 0.25 | 287 | 1.93 | 0.82 | Comparative material |

While the present invention has been particularly shown and described with reference to exemplary embodiments thereof, it will be understood by those skilled in the art that various changes in form and details may be made therein without departing from the spirit and scope of the invention as defined by the appended claims.

Therefore, it should be understood that the foregoing exemplary embodiments are not limited but are illustrated. The scope of the present invention is represented by claims to be described later rather than the detailed description, and it should be recognized that the meaning and scope of the claims and an entire change or a changed form that is derived from an equivalent concept thereof are included in the scope of the present invention.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. An annealing separating agent comprising MgO, an oxychloride material, and a sulfate-based antioxidant, wherein the oxychloride material is included at a ratio of 10-20 wt % to the MgO at 100 weight part, and the sulfate-based antioxidant is included at a ratio of 3.5-7.5 wt % to the MgO at 100 weight part, wherein the oxychloride material is antimony oxychloride (SbOCl).

2. The annealing separating agent of claim 1, wherein the sulfate-based antioxidant is at least one that is selected from an antimony-based ($Sb_2(SO_4)_3$), strontium-based ($SrSO_4$), or barium-based ($BaSO_4$) antioxidant.

3. A method of manufacturing an oriented electrical steel sheet, the method comprising:

producing a hot rolled steel sheet by hot rolling a steel slab;

producing a cold rolled steel sheet by cold rolling the hot rolled steel sheet;

performing decarburization annealing and nitride annealing on the cold rolled steel sheet; and applying an annealing separating agent comprising MgO, an oxychloride material, and a sulfate-based antioxidant, and a glassless additive comprising water, and performing final annealing on the electrical steel sheet of which the decarburization annealing and nitride annealing is complete, wherein the oxychloride material is included at a ratio of 10-20 wt % to the MgO at 100 weight part, and the sulfate-based antioxidant is included at a ratio of 3.5-7.5 wt % to the MgO at 100 weight part, wherein the oxychloride material is antimony oxychloride (SbOCl).

4. The method of claim 3, wherein the sulfate-based antioxidant is at least one that is selected from an antimony-based ($Sb_2(SO_4)_3$), strontium-based ($SrSO_4$), or barium-based ($BaSO_4$) antioxidant.

5. The method of claim 3, wherein an amount of $SiO_2$ that is formed at a surface of the electrical steel sheet of which the decarburization annealing and nitride annealing is complete is two times to five times greater than that of $Fe_2SiO_4$.

6. The method of claim 5, wherein the decarburization and nitride annealing process is performed in a dew point range of 35-55° C.

7. The method of claim 6, wherein an activation level of the MgO is 400-3000 seconds.

8. The method of claim 7, wherein upon the final annealing, a temperature rising speed is 18-75° C./h in a temperature range of 700-950° C., and a temperature rising speed is 10-15° C./h in a temperature range of 950-1200° C.

9. The method of claim 8, wherein in the decarburization and nitride annealing, a temperature is 800-950° C.

10. The method of claim 9, wherein the glassless additive is applied at 5-8 g/m$^2$.

11. The method of claim 10, wherein the steel slab comprises Sn at 0.03-0.07 wt %, Sb at 0.01-0.05 wt %, and P at 0.01-0.05 wt %, the remaining portion comprises Fe and other inevitably added impurities, and the steel slab satisfies P+0.5Sb at 0.0370-0.0630 wt %.

12. The annealing separating agent of claim 1 excluding chlorides.

13. The annealing separating agent of claim 1 applied to a steel.

* * * * *